US011148277B2

(12) United States Patent
Hu

(10) Patent No.: US 11,148,277 B2
(45) Date of Patent: Oct. 19, 2021

(54) SCREWDRIVER BIT ACCOMMODATING SEAT RETAINING STRUCTURE OF SCREWDRIVER

(71) Applicant: GONG FONG ENTERPRISE CO., LTD., Tainan (TW)

(72) Inventor: Cheng-Te Hu, Tainan (TW)

(73) Assignee: Gong Fong Enterprise Co., Ltd., Tainan (TW)

( * ) Notice: Subject to any disclaimer, the term of this patent is extended or adjusted under 35 U.S.C. 154(b) by 283 days.

(21) Appl. No.: 16/550,491

(22) Filed: Aug. 26, 2019

(65) Prior Publication Data

US 2021/0060758 A1 Mar. 4, 2021

(51) Int. Cl.

| | |
|---|---|
| ***B25G 1/08*** | (2006.01) |
| ***B25B 23/16*** | (2006.01) |
| ***B25B 23/00*** | (2006.01) |
| ***B25B 15/02*** | (2006.01) |

(52) U.S. Cl.

CPC ..... *B25G 1/085* (2013.01); *B25B 23/0035* (2013.01); *B25B 23/16* (2013.01); *B25B 15/02* (2013.01)

(58) Field of Classification Search

CPC ..... B25G 1/085; B25B 15/00; B25B 15/02; B25B 23/0035; B25B 23/16

See application file for complete search history.

(56) References Cited

U.S. PATENT DOCUMENTS

| | | | | |
|---|---|---|---|---|
| 8,590,432 | B2 * | 11/2013 | Wang | B25G 1/085 81/177.4 |
| 2013/0055861 | A1 * | 3/2013 | Wang | B25G 1/085 81/490 |
| 2016/0214239 | A1 * | 7/2016 | Jiang | B25B 23/12 |
| 2017/0072554 | A1 * | 3/2017 | Chen | B25G 1/085 |

FOREIGN PATENT DOCUMENTS

| | | |
|---|---|---|
| TW | M267031 U | 6/2005 |

* cited by examiner

*Primary Examiner* — David B. Thomas
(74) *Attorney, Agent, or Firm* — Rosenberg, Klein & Lee

(57) ABSTRACT

A screwdriver bit accommodating seat retaining structure of a screwdriver includes a main body, a fixing unit, and an accommodating seat. The main body has an accommodating chamber therein and two ends defined as a fixing end and an open end. The fixing unit includes a shaft, a plug, an elastic member, and a fixing member. One end of the shaft has a plug hole. The plug is fixed in the plug hole. The elastic member is made of a metal material and has at least one elastic piece. The elastic member has a perforation. The fixing member is inserted through the perforation to fix the elastic member to the plug. The accommodating seat is fitted onto the fixing unit, and has at least one clamping groove, and is connected with a cap. An inner edge of the accommodating seat is annularly provided with an engaging portion.

10 Claims, 7 Drawing Sheets

SCREWDRIVER BIT ACCOMMODATING SEAT RETAINING STRUCTURE OF SCREWDRIVER

FIELD OF THE INVENTION

The present invention relates to a retaining structure, and more particularly to a screwdriver bit accommodating seat retaining structure of a screwdriver which can prevent elastic pieces from being fatigued or broken so as to prolong the service life.

BACKGROUND OF THE INVENTION

There are various screwdrivers with a retractable screwdriver bit cartridge on the market. For example, Taiwan Utility Model Publication No. M267031 discloses an improved screwdriver published on Jun. 11, 2005. The improved screwdriver comprises a handle having one end provided with a cylindrical compartment. The outside of the handle is formed with a hole communicating with the compartment. The opening of the compartment is closed by a cap. The cap has a guide hole disposed at an eccentric position relative to the compartment. A circular cylinder is fitted in the compartment. One end of the cylinder is pivoted to the inner end surface of the compartment, and the other end of the cylinder is pivoted to the cover. The outer circumference of the cylinder is annularly provided with a plurality of spaced receiving groove. The receiving grooves are in communication with the guide hole of the cap, so that screwdriver bits can be placed in and taken out from the receiving grooves. The improved screwdriver has two features described below.

1. The cylinder has an accommodating room corresponding in position to the inner end surface of the compartment. A spring is disposed between the accommodating room and the inner end surface of the compartment for pushing and positioning the cylinder to the cover.

2. The cover is formed with a plurality of spaced recesses arranged around the cylinder. The cylinder is provided with corresponding protrusions corresponding in position to the recesses of the cover. When the cylinder is rotated in the compartment, the recesses and the protrusions play the role of node positioning.

With these two special structural arrangements, the cylinder has the advantage of precise positioning, and the screwdriver bits can be placed in and taken out from the compartment with ease.

The handle of the foregoing patent has three buckle notches equally spaced around the outer circumference of the opening of the compartment. The cover is provided with three protruding buckle rods corresponding in position to the three buckle notches of the handle. The three buckle rods are buckled and secured to the three buckle notches, thereby closing the compartment. Since the three buckle rods of the cover are integrally formed of a plastic material, it is easy to lose elasticity or break due to plastic embrittlement after long-term use. As a result, the compartment cannot be closed. Sometimes the entire screwdriver can no longer be used. Accordingly, the inventor of the present invention has devoted himself based on his many years of practical experiences to solve these problems.

SUMMARY OF THE INVENTION

In view of the above shortcomings, the primary object of the present invention is to provide a screwdriver bit accommodating seat retaining structure of a screwdriver, comprising a main body, a fixing unit, and an accommodating seat. The main body has an accommodating chamber therein. Two ends of the main body are defined as a fixing end and an open end, respectively. The fixing unit is fixed in the accommodating chamber. The fixing unit includes a shaft, a plug, an elastic member, and a fixing member. One end of the shaft is formed with a plug hole. The plug is fixed in the plug hole. The elastic member is made of a metal material and has at least one elastic piece. The elastic member is provided with a perforation. The fixing member is inserted through the perforation and fixed to the plug so as to fix the elastic member to the plug. The accommodating seat is movably disposed in the accommodating chamber. The accommodating seat has a through hole therein. The accommodating seat is fitted onto a periphery of the fixing unit. The accommodating seat is provided with at least one clamping groove. The accommodating seat is connected with a cap. An inner edge of the accommodating seat is annularly provided with an engaging portion. The elastic piece is elastically engaged with the engaging portion so that the cap is secured to the open end to close the accommodating chamber.

Preferably, an engaging block is disposed in the fixing end. Two ends of the engaging block are formed with an insertion hole and a threaded end, respectively. Another end of the shaft is formed with a threaded section. The threaded section is threadedly connected to the threaded end.

Preferably, one side of the plug, opposite to the plug hole, is provided with a cross-shaped recessed portion. The elastic member is in a corresponding cross shape. The elastic member is engaged in the recessed portion to be constrained so that the elastic member does not rotate relative to the plug.

Preferably, the fixing member is a screw. The recessed portion is provided with a screw hole. The fixing member is inserted through the perforation and screwed into the screw hole.

Preferably, the plug is provided with a groove. When the plug bears a pressure from the shaft, the groove generates a contraction and deformation allowance inwardly.

Preferably, the screw hole communicates with the groove. The fixing member is screwed into the screw hole to generate an outward force to the plug so that the plug is tightly fixed to the shaft.

Preferably, the groove is in a cross shape.

Preferably, the at least one elastic piece of the elastic member includes four elastic pieces extending outwardly.

Preferably, one end of the accommodating seat is sleeved with a limiting ring. The limiting ring is confined in the accommodating chamber. An inner edge of the end sleeved with limiting ring of the accommodating seat is provided with a flange. The flange has an inner diameter less than an outer diameter of the plug. When the accommodating seat is pulled outwardly, the flange is blocked by the plug so that the accommodating seat cannot be completely separated from the accommodating chamber.

Preferably, an annular protruding block is disposed on a periphery of another end of the accommodating seat. An annular groove is disposed on an inner edge of the cap. The annular protruding block is engaged into the annular groove so that the accommodating seat is movably connected to the cap.

According to the above technical features, the following effects can be achieved:

1. Because the elastic member with the four elastic pieces is made of a metal material, it can be used for a long period of time, and it is not easy to be fatigued or broken so as to prolong its service life.

2. Since the plug and the elastic member are separable, the elastic member whose elastic pieces have been deformed, broken or damaged can be easily replaced, thereby prolonging its service life.

DETAILED DESCRIPTION OF THE PREFERRED EMBODIMENTS

Embodiments of the present invention will now be described, by way of example only, with reference to the accompanying drawings.

Figure 1:
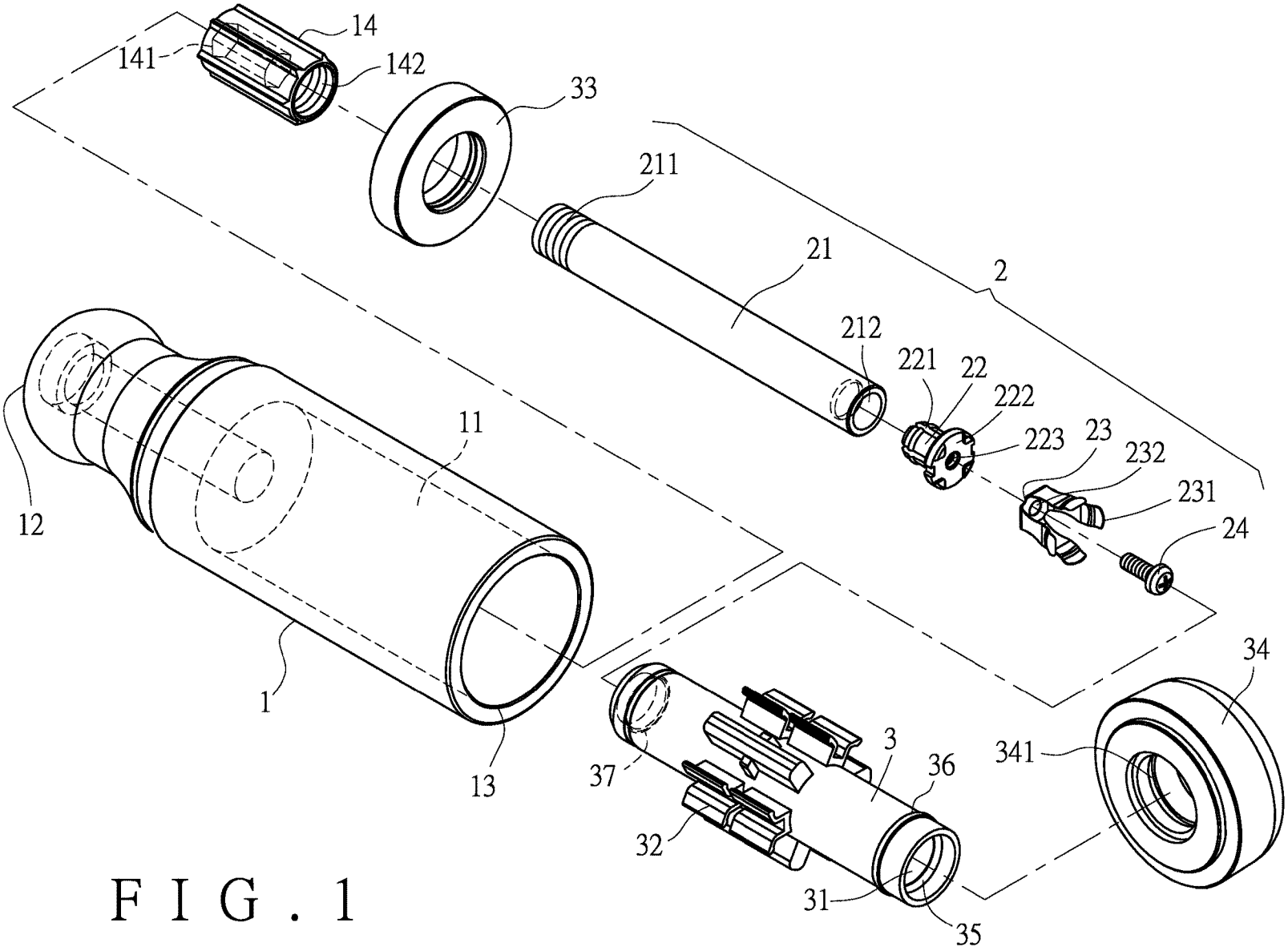
FIG. 1 is an exploded view in accordance with an embodiment of the present invention.
Figure 2:
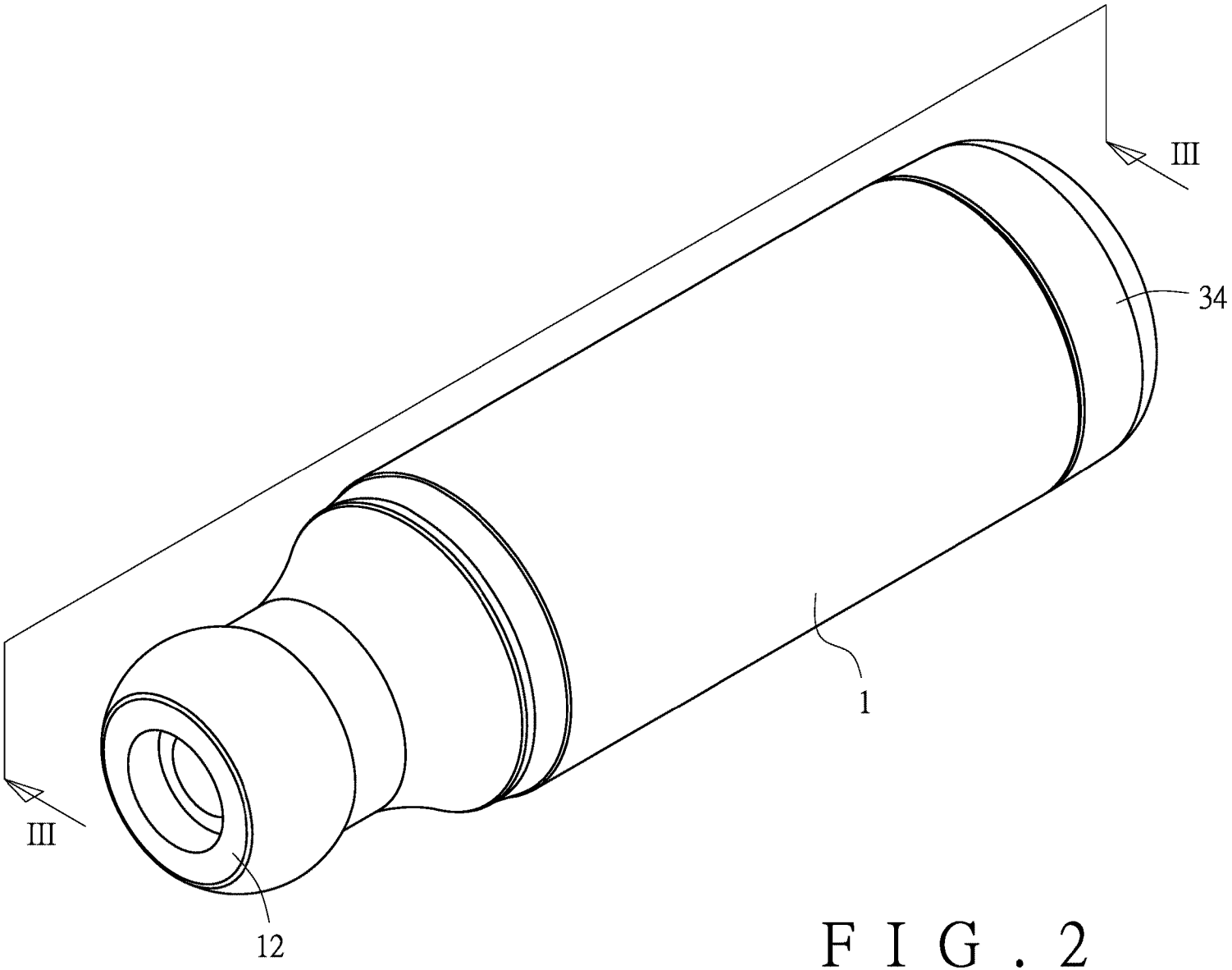
FIG. 2 is a perspective view in accordance with an embodiment of the present invention.
Figure 3:
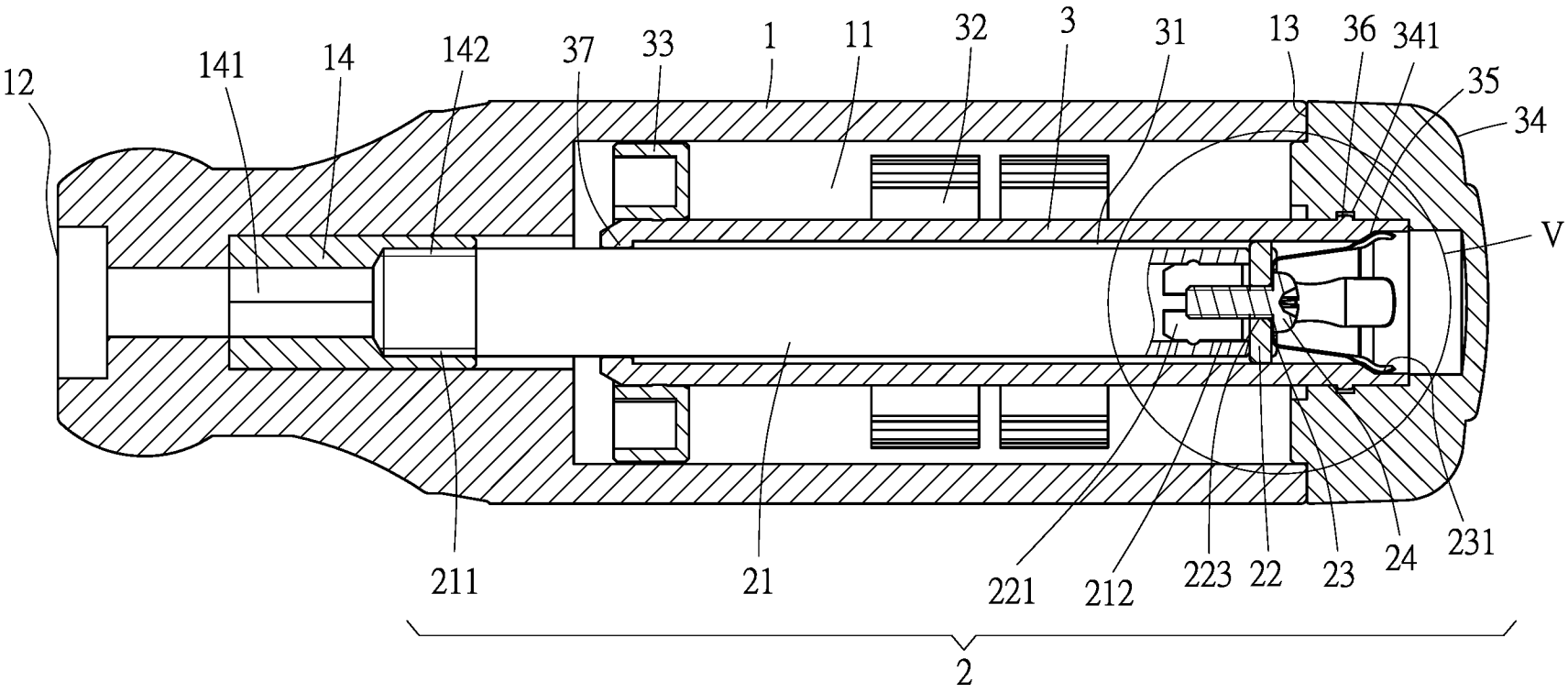
FIG. 3 is a sectional view taken along line III-III of FIG. 2.

Referring to FIG. 1, FIG. 2 and FIG. 3, a screwdriver bit accommodating seat retaining structure of a screwdriver in accordance with an embodiment of the present invention comprises a main body (1), a fixing unit (2), and an accommodating seat (3).

The main body (1) has an accommodating chamber (11) therein. Two ends of the main body (1) are defined as a fixing end (12) and an open end (13), respectively. The fixing end (12) and an open end (13) are in communication with the accommodating chamber (11). An engaging block (14) is disposed in the fixing end (12). Two ends of the engaging block (14) are formed with an insertion hole (141) and a threaded end (142), respectively. The insertion hole (141) corresponds to the fixing end (12).

The fixing unit (2) is fixed in the accommodating chamber (11). The fixing unit (2) includes a shaft (21), a plug (22), an elastic member (23) and a fixing member (24). Two ends of the shaft (21) are formed with a threaded section (211) and a plug hole (212), respectively. The threaded section (211) is threadedly connected to the threaded end (142) of the engaging block (14). The plug (22) is provided with a cross-shaped groove (221). When the plug (22) bears a pressure from the shaft (21), the groove (221) generates a contraction and deformation allowance inwardly (toward the center point), so that the plug (22) can be fixed in the plug hole (212). One side of the plug (22), opposite to the plug hole (212), is provided with a cross-shaped recessed portion (222). The recessed portion (222) is provided with a screw hole (223). The screw hole (223) communicates with the groove (221). The elastic member (23) is made of a metal material and has a cross shape. The elastic member (23) has four elastic pieces (231) extending outwardly. The elastic member (23) is provided with a perforation (232). The fixing member (24) is inserted through the perforation (232) and screwed into the screw hole (223). The fixing member (24) is a screw. When the fixing member (24) is screwed into the screw hole (223) to generate an outward force to the plug (22), the plug (22) is tightly fixed to the shaft (21) so as to fix the elastic member (23) to the plug (22). Through the cross-shaped elastic member (23) engaged in the cross-shaped recessed portion (222) to be constrained, the elastic member (23) does not rotate relative to the plug (22).

Figure 7:
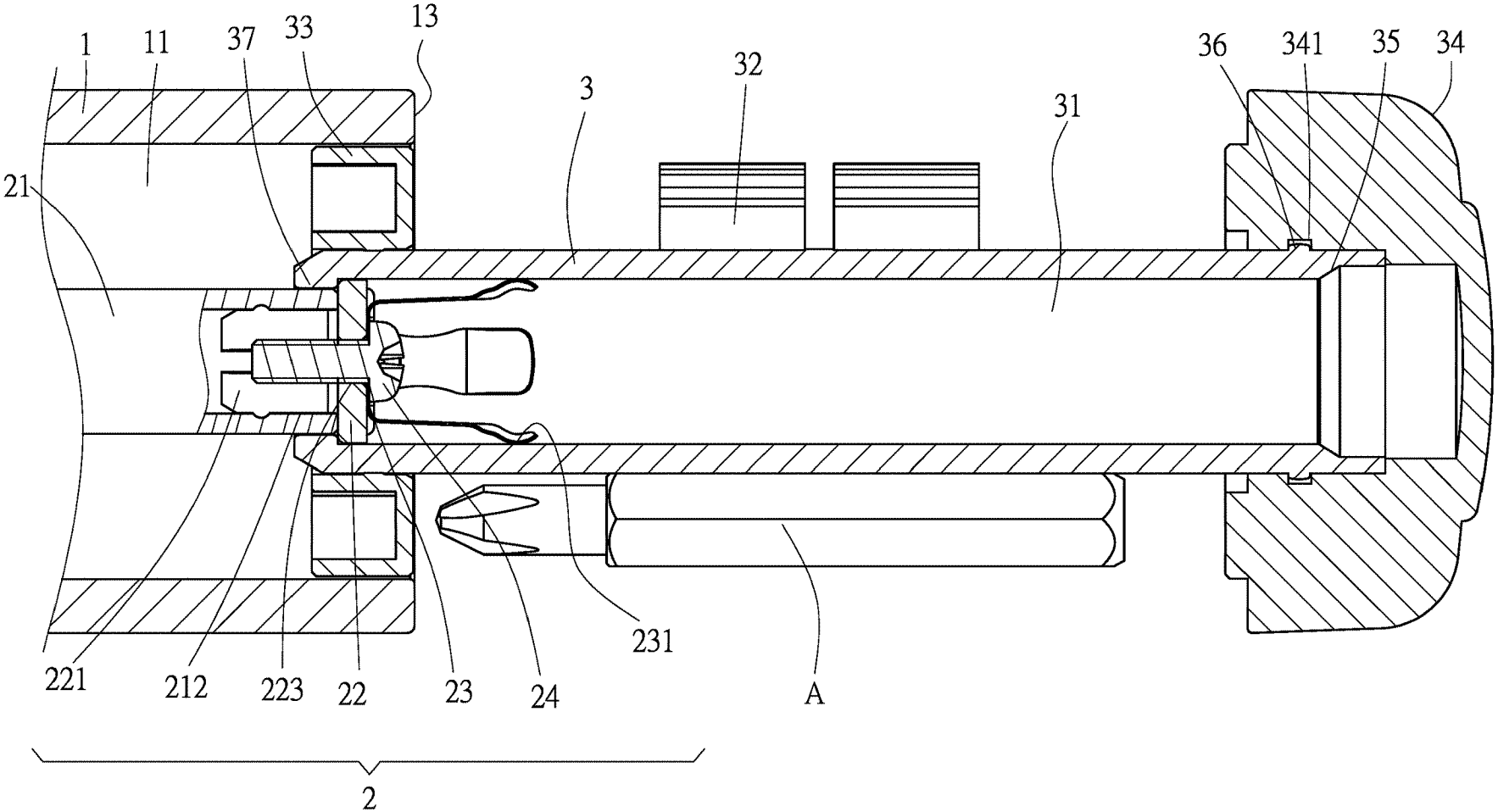
FIG. 7 is a sectional view taken along line VII-VII of FIG. 6.

The accommodating seat (3) is movably disposed in the accommodating chamber (11). The accommodating seat (3) has a through hole (31) therein. The accommodating seat (3) is fitted onto the periphery of the fixing unit (2). The periphery of the accommodating seat (3) is provided with a plurality of clamping grooves (32) for clamping and retaining a plurality of screwdriver bits. One end of the accommodating seat (3) is sleeved with a limiting ring (33). The limiting ring (33) is confined in the accommodating chamber (11). The other end of the accommodating seat (3) is movably engaged with a cap (34). The inner edge of the other end of the accommodating seat (3) is annularly provided with an engaging portion (35). The four elastic pieces (231) are elastically engaged with the engaging portion (35), so that the cap (34) is secured to the open end (13) to close the accommodating chamber (11). An annular protruding block (36) is disposed on the periphery of the other end of the accommodating seat (3). An annular groove (341) is disposed on an inner edge of the cap (34). The annular protruding block (36) is engaged into the annular groove (341) so that the accommodating seat (3) is movably connected to the cap (34). The inner edge of the end sleeved with limiting ring (33) of the accommodating seat (3) is provided with a flange (37). The inner diameter of the flange (37) is less than the outer diameter of the plug (22). When the accommodating seat (3) is pulled outwardly, the flange (37) is blocked by the plug (22), so the accommodating seat (3) cannot be completely separated from the accommodating chamber (11) (as shown in FIG. 7).

Figure 4:
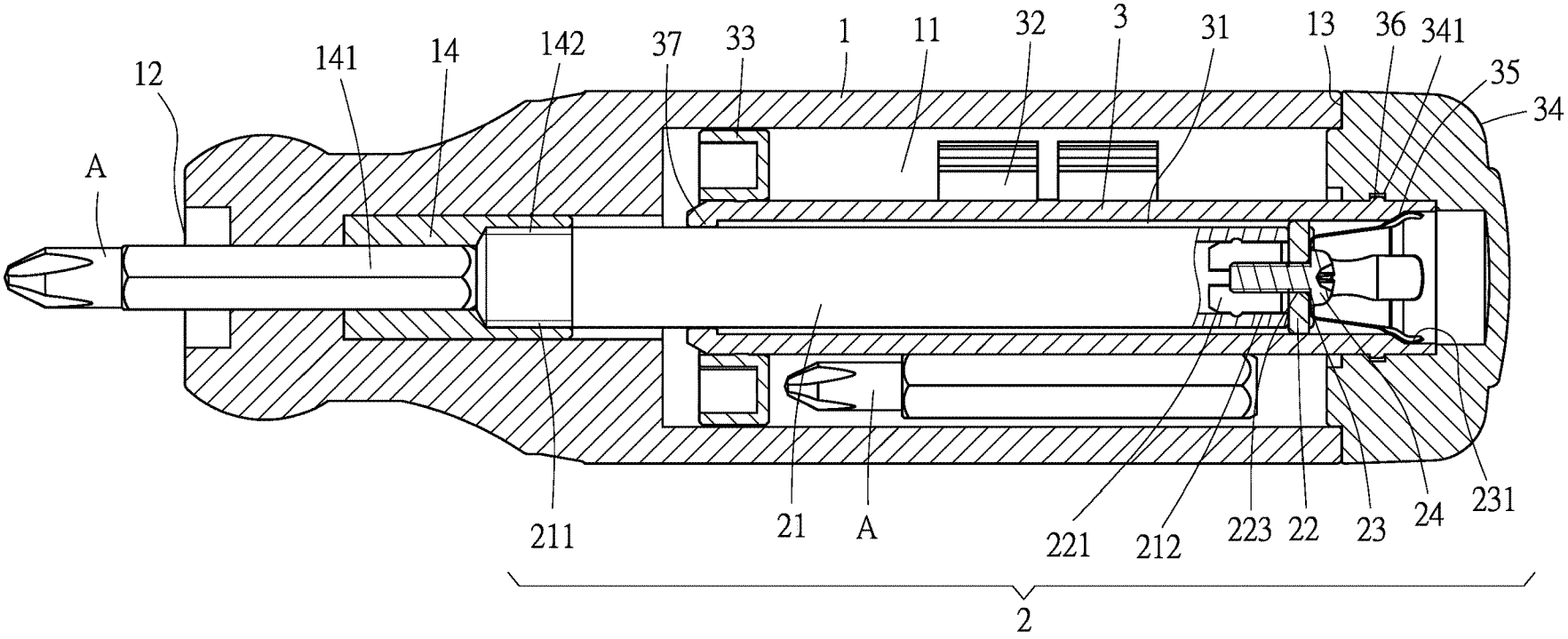
FIG. 4 is a schematic view in accordance with an embodiment of the present invention when in use.
Figure 5:
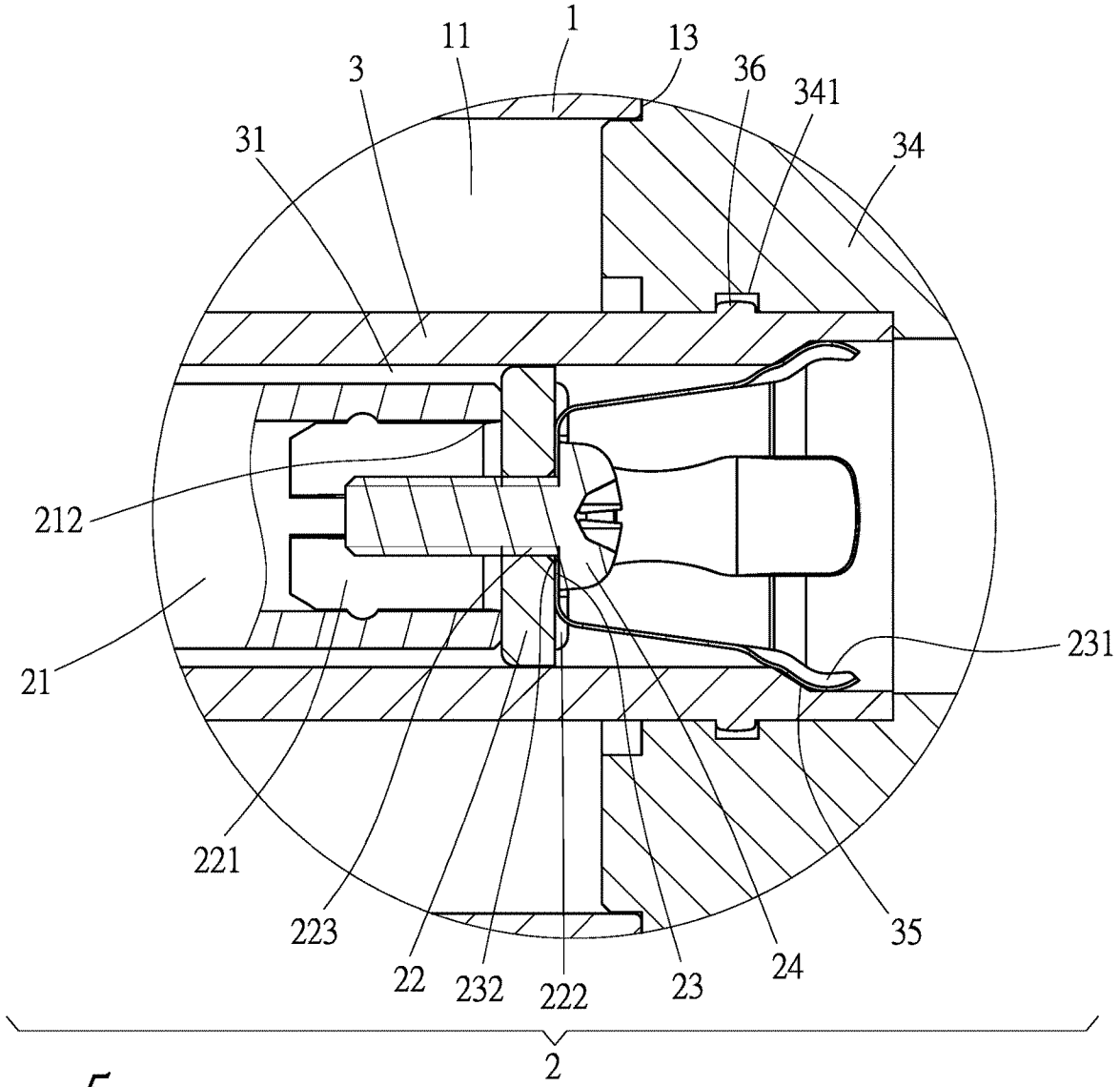
FIG. 5 is an enlarged view of circle V of FIG. 3.
Figure 6:
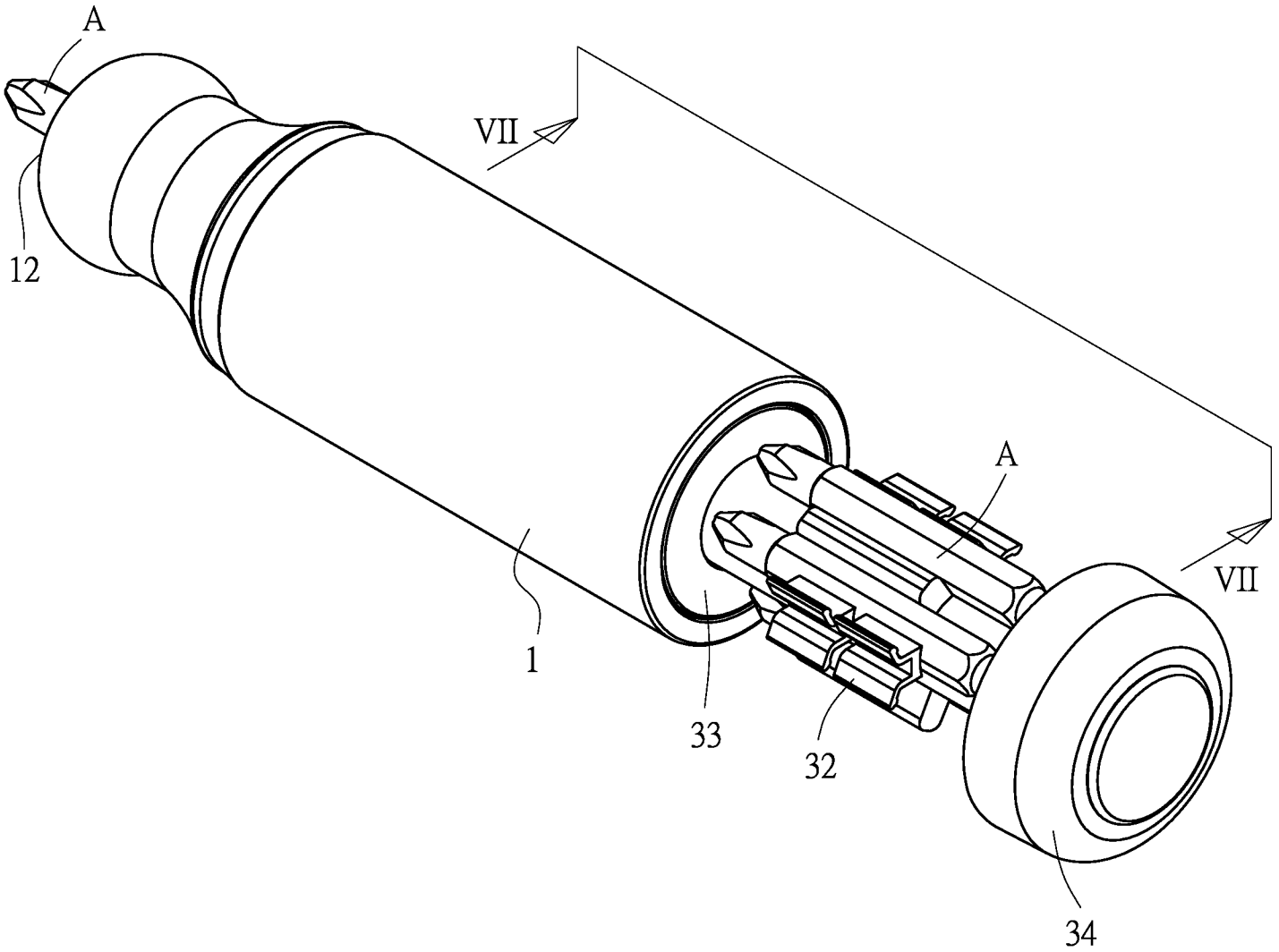
FIG. 6 is a schematic view in accordance with an embodiment of the present invention, showing that the accommodation seat is pulled outwardly from the main body.

In use, as shown in FIG. 1 and FIG. 4, a screwdriver bit (A) is inserted and secured in the insertion hole (141) of the engaging block (14) via the fixing end (12) of the main body (1). The user can hold the main body (1) to screw or unscrew a bolt using the screwdriver bit (A). The other screwdriver bits (A) in different sizes can be placed in the accommodating chamber (11) for storage. Firstly, the cap (34) on the open end (13) of the main body (1) is pulled outwardly, so that the engaging portion (35) of the inner edge of the accommodating seat (3) are disengaged from the four elastic pieces (231), no longer being elastically buckled by the four elastic pieces (231). Then, the accommodating seat (3) and the cap (34) are pulled outwardly, and the flange (37) of the limiting ring (33) is blocked by the plug (22), so that the accommodating seat (3) cannot be completely separated from the accommodating chamber (11) (as shown in FIG. 6 and FIG. 7), and then the other screwdriver bits (A) are clamped and retained in the clamping grooves (32) one by one. After that, the accommodating seat (3) is pushed into the accommodating chamber (11) of the main body (1), and the limiting ring (33) at one end of the accommodating seat (3) is inserted and secured in the accommodating chamber (11), and the cap (34) is correspondingly engaged with the open end (13) of the main body (1). Through the four elastic pieces (231) of the elastic member (23) respectively elastically engaged with the engaging portion (35) at the inner edge of the accommodating seat (3), the cap (34) is secured to the open end (13) (as shown in FIG. 5) to close the accommodating chamber (11). Because the elastic member (23) with the four elastic pieces (231) is made of a metal material, it can be used for a long period of time, and it is not easy to be fatigued or broken so as to prolong its service life.

Referring to FIG. 1, when the four elastic pieces (231) of the elastic member (23) need to be replaced if they are deformed, broken or damaged, since the plug (22) and the elastic member (23) are separable, it is only necessary to unscrew the fixing member (24) on the plug (22), thereby separating the elastic member (23) from the plug (22). Then, a new elastic member (23) is screwed onto the plug (22) by the fixing member (24), so that the elastic member (23) can be easily and conveniently replaced, thereby prolonging its service life.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A screwdriver bit accommodating seat retaining structure of a screwdriver, comprising:

a main body, having an accommodating chamber therein, two ends of the main body being defined as a fixing end and an open end, respectively;

a fixing unit, fixed in the accommodating chamber, the fixing unit including a shaft, a plug, an elastic member and a fixing member, one end of the shaft being formed with a plug hole, the plug being fixed in the plug hole, the elastic member being made of a metal material and having at least one elastic piece, the elastic member being provided with a perforation, the fixing member being inserted through the perforation and fixed to the plug so as to fix the elastic member to the plug;

an accommodating seat, movably disposed in the accommodating chamber, the accommodating seat having a through hole therein, the accommodating seat being fitted onto a periphery of the fixing unit, the accommodating seat being provided with at least one clamping groove, the accommodating seat being connected with a cap, an inner edge of the accommodating seat being annularly provided with an engaging portion, the elastic piece being elastically engaged with the engaging portion so that the cap is secured to the open end to close the accommodating chamber.

2. The screwdriver bit accommodating seat retaining structure of the screwdriver as claimed in claim 1, wherein an engaging block is disposed in the fixing end, two ends of the engaging block are respectively formed with an insertion hole and a threaded end, another end of the shaft is formed with a threaded section, and the threaded section is threadedly connected to the threaded end.

3. The screwdriver bit accommodating seat retaining structure of the screwdriver as claimed in claim 1, wherein one side of the plug, opposite to the plug hole, is provided with a cross-shaped recessed portion, the elastic member is in a corresponding cross shape, and the elastic member is engaged in the recessed portion to be constrained so that the elastic member does not rotate relative to the plug.

4. The screwdriver bit accommodating seat retaining structure of the screwdriver as claimed in claim 3, wherein the fixing member is a screw, the recessed portion is provided with a screw hole, and the fixing member is inserted through the perforation and screwed into the screw hole.

5. The screwdriver bit accommodating seat retaining structure of screwdriver as claimed in claim 4, wherein the plug is provided with a groove, when the plug bears a pressure from the shaft, the groove generates a contraction and deformation allowance inwardly.

6. The screwdriver bit accommodating seat retaining structure of the screwdriver as claimed in claim 5, wherein the screw hole communicates with the groove, and the fixing member is screwed into the screw hole to generate an outward force to the plug so that the plug is tightly fixed to the shaft.

7. The screwdriver bit accommodating seat retaining structure of the screwdriver as claimed in claim 5, wherein the groove is in a cross shape.

8. The screwdriver bit accommodating seat retaining structure of the screwdriver as claimed in claim 1, wherein the at least one elastic piece of the elastic member includes four elastic pieces extending outwardly.

9. The screwdriver bit accommodating seat retaining structure of the screwdriver as claimed in claim 1, wherein one end of the accommodating seat is sleeved with a limiting ring, the limiting ring is confined in the accommodating chamber, an inner edge of the end sleeved with limiting ring of the accommodating seat is provided with a flange, the flange has an inner diameter less than an outer diameter of the plug, when the accommodating seat is pulled outwardly, the flange is blocked by the plug so that the accommodating seat cannot be completely separated from the accommodating chamber.

10. The screwdriver bit accommodating seat retaining structure of the screwdriver as claimed in claim 1, wherein an annular protruding block is disposed on a periphery of another end of the accommodating seat, an annular groove is disposed on an inner edge of the cap, and the annular protruding block is engaged into the annular groove so that the accommodating seat is movably connected to the cap.

* * * * *